US006004155A

United States Patent [19]

Wu

[11] Patent Number: 6,004,155

[45] Date of Patent: Dec. 21, 1999

[54] CARD CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/123,777

[22] Filed: Jul. 28, 1998

[51] Int. Cl.[6] ..... H01R 3/00

[52] U.S. Cl. ..... 439/489; 439/188; 439/259

[58] Field of Search ..... 439/188, 489, 439/630, 260, 59, 325, 326, 327, 259; 200/51.09

[56] References Cited

U.S. PATENT DOCUMENTS 4,687,268 8/1987 Picciotto et al. ..... 439/55
4,891,013 1/1990 Komaki ..... 439/66
5,013,255 5/1991 Juret et al. ..... 439/260
5,370,544 12/1994 Reichardt et al. ..... 439/188

*Primary Examiner*—Paula Bradley
*Assistant Examiner*—Alexander Gilman

[57] ABSTRACT

A card connector includes a switch installed therein for generating on/off status in response to the insertion/withdrawal of an electrical card. The switch includes an elastic plate having a fulcrum end fixed in the connector, a free end normally connected to two separated metal plates fixed in the connector and an intermediate portion connected between the fulcrum end and the free end. An extension is formed in the intermediate portion of the elastic plate for receiving a force from the inserted card to urge the free end away from contacting with the two metal plates.

11 Claims, 4 Drawing Sheets

CARD CONNECTOR

BACKGROUND OF THE INVENTION

1. Field of the Invention

The present invention relates to a card connector and particularly to a card connector having a switch function during insertion/withdrawal of the related electrical card.

2. The Prior Art

Memory cards have become popularly due to the trend of compact size, modularization, and object oriented requirement of the computer industry. The memory cards are usually inserted into a card connector installed in a portable computer. For clearly identifying the insertion/withdrawal of the memory card with respect to the card connector, some card connectors are installed with a switch to more specifically control the electrical engagement/disengagement between the electrical card and the card connector. Such techniques are disclosed in U.S. Pat. Nos. 4,735,578, 4,752,234, 4,900,272, 4,900,273, 5,013,255, 5,334,034, 5,370,544, and 5,380,997. For example, U.S. Pat. No. 5,370,544 shown in FIG. 4 discloses a card connector 4 having a housing 40 in which a first metal plate 41 and a second metal plate 42 are fixed. Normally, the first and second plates 41, 42 are electrically connected to each other via respective end portions 411, 421. A protrusion 412 extends from the first plate 41 for receiving a force from an inserted card 5 so as to prevent the first plate 41 from contacting the second plate 42. A considerable contact resistance exists between the end portions 411, 421 of the plates 41, 42 because the contacting area therebetween is generally very narrow, similar to a line area. Moreover, the normal contact resistance will further increase due to the gradual loosening contact between the plates 41, 42 after extended use. If the contact resistance rises to a relatively large value, the switch may cause a malfunction of the related printed circuit board on which the card connected is mounted. Thus, it is requisite to provide a new switch for use in a card connector which will not malfunction due to a large contact resistance.

SUMMARY OF THE INVENTION

The primary purpose of the present invention is to provide a card connector having switch means which changes switching status in response to the position of an externally inserted card.

A second purpose of the present invention is to provide a card connector having switch means providing a relatively large contacting area for effectively minimizing contact resistance.

In accordance with one aspect of the present invention, a card connector comprises an insulative housing having a base defining a plurality of passageways for receiving contacts therein, and a reception space defined between two side walls extending upward from the base for receiving an externally inserted card. A first stop member and a second stop member project upward from the base and are in alignment with each other for stopping the externally inserted card. An elastic plate includes a first portion connected to the first stop member and a second portion electrically contacting two separated metal switch plates which are partially received in and partially extend from the second stop member. The contacting area between the second portion of the elastic plate and the two metal switch plates is sufficiently large to neglect the contact resistance therebetween. A driving portion extends from an intermediate portion between the first portion and the second portion of the elastic plate beyond an aligned line of the first stop member and the second stop member. The elastic plate is electrically disconnected from the metal switch plates when the driving portion thereof receives a force from an externally inserted card.

In accordance with another aspect of the present invention, a card connector comprises an insulative housing having a base defining a plurality of passageways for receiving contacts therein, and a reception space defined between two side walls extending upward from the base for receiving an externally inserted card, a first switch reception member formed in a first portion of the base, a second switch reception member formed in a second portion of the base, metal switch means having a first portion firmly received in the first switch reception member, a second portion firmly received in the second switch reception member, and a third portion flexibly integrated with the first portion. The third portion of the switch means switchably contacts with a second portion of the switch means when the card impacts on/departs from an interconnection between the third portion and the first portion of the switch means. The contacting area between the first portion and third portion of the switch means is sufficiently large to neglect the contact resistance therebetween.

These and additional objects, features and advantages of the present invention will become apparent after reading the following detailed description of the preferred embodiment of the invention taken in conjunction with the appended drawing figures.

DETAILED DESCRIPTION OF THE PREFERRED EMBODIMENTS

Figure 1:
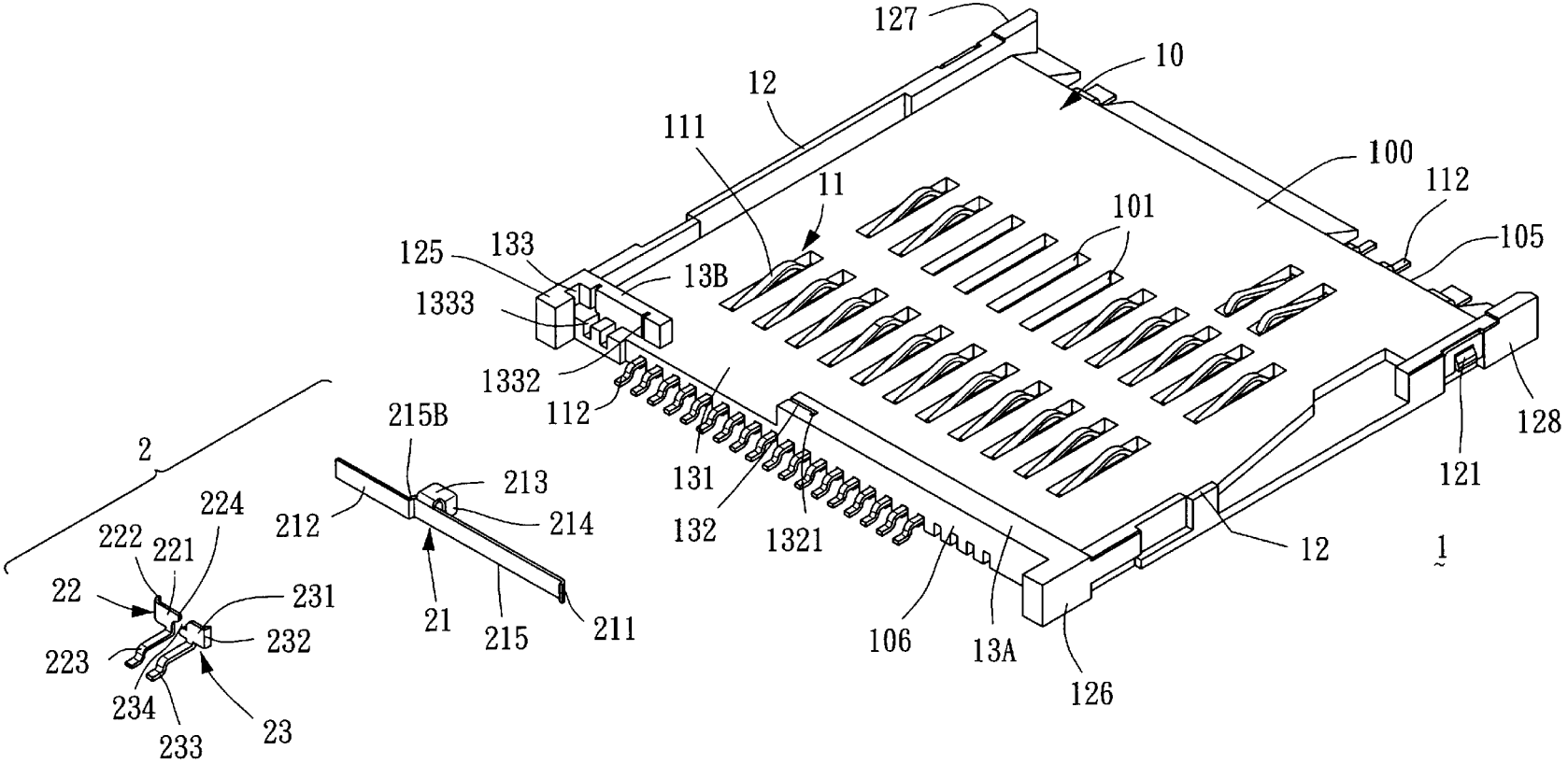
FIG. 1 is an exploded view of a card connector in accordance with the present invention.
Figure 2:
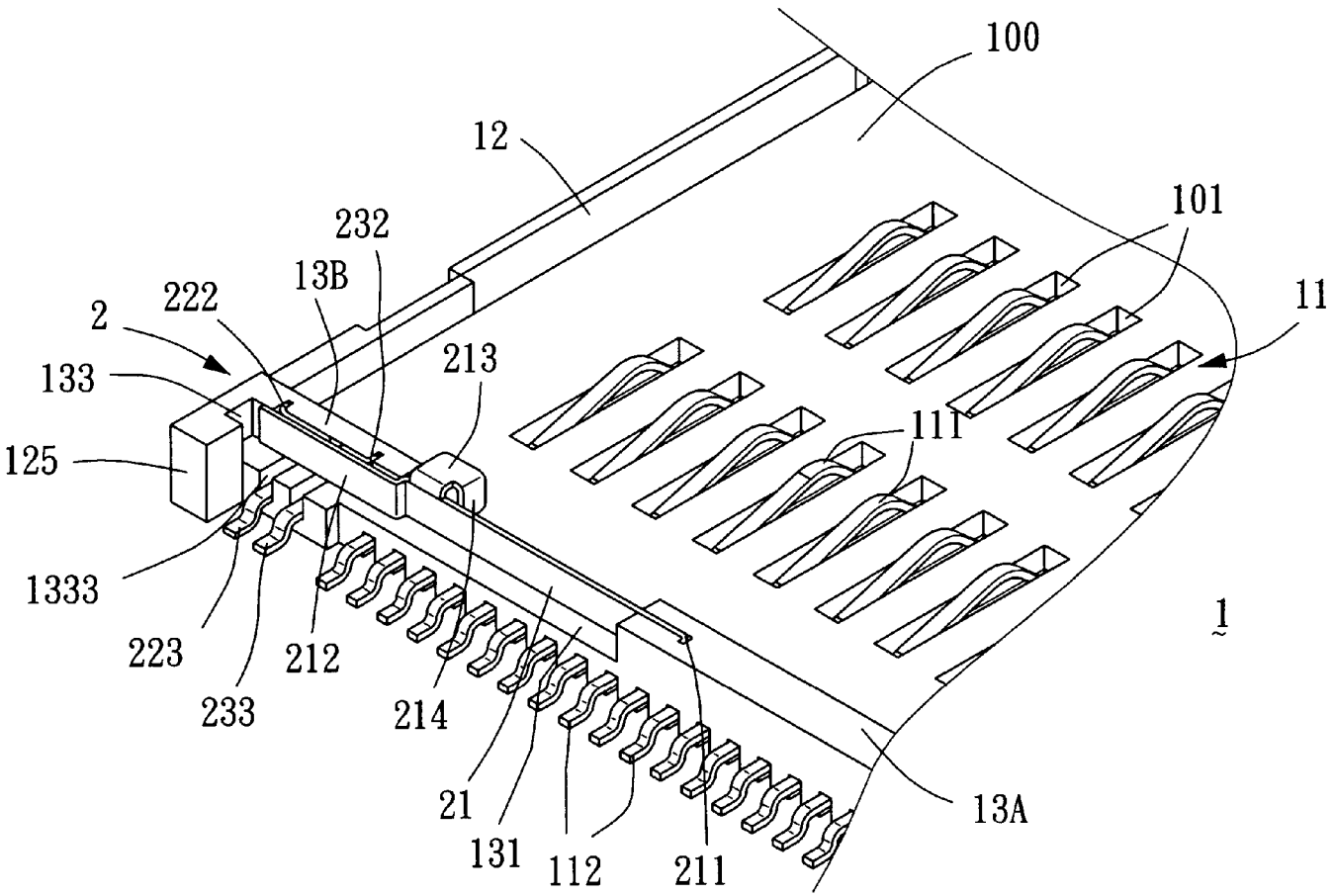
FIG. 2 is an assembled partial view of FIG. 1.
Figure 3:
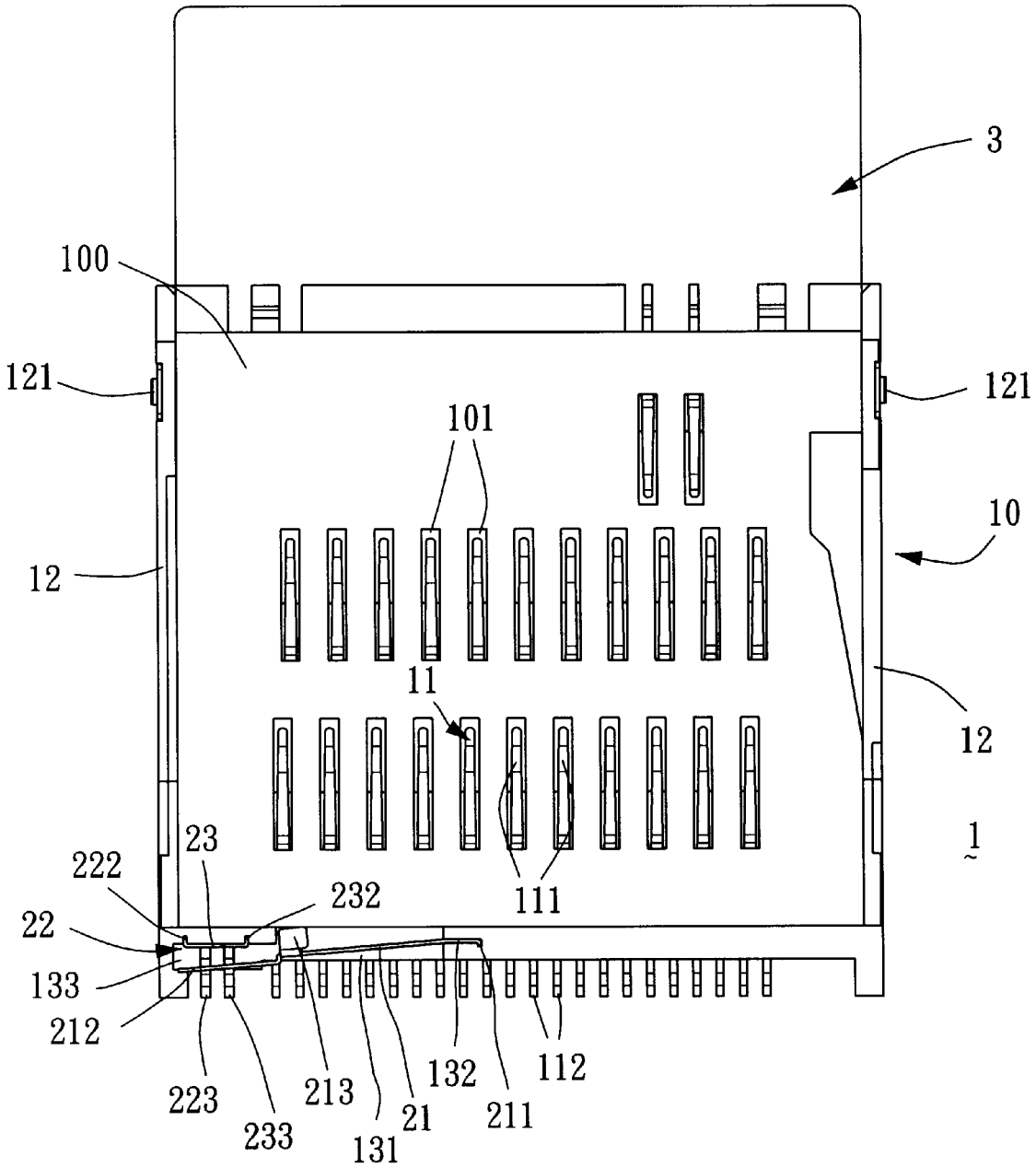
FIG. 3 is a top view of the card connector showing a switch means thereof in an "off" status.
Figure 4:
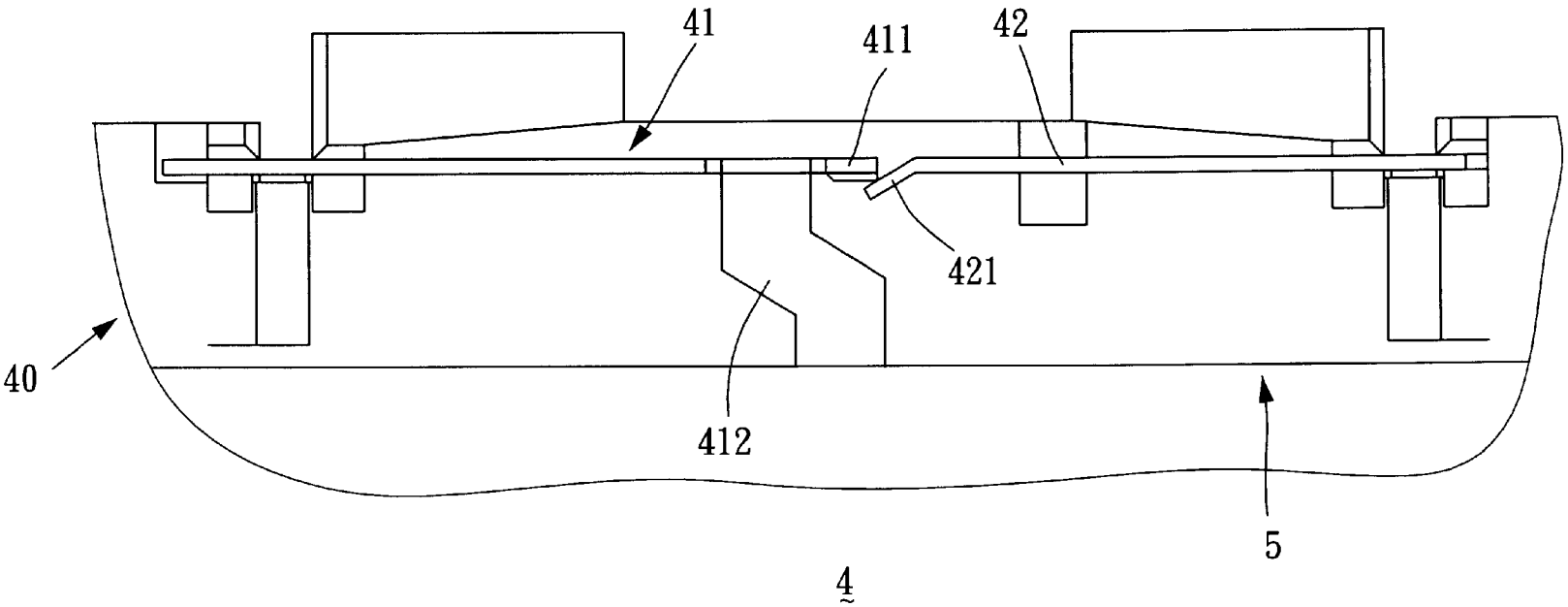
FIG. 4 PRIOR ART
FIG. 4 is a schematic top view of a conventional card connector.

Referring to FIGS. 1 and 2, a card connector 1 in accordance with the present invention comprises a base 10 defining a plurality of passageways 101 for receiving contacts 11 therein, and a reception space 100 defined between the base 10 and two opposite side walls 12 extending upward therefrom for receiving an externally inserted card 3 (FIG. 3). First and second stop members 13A, 13B separately project upward from the base 10 thus defining a space 131 therebetween. The stop members 13A and 13B are in alignment with each other for stopping the externally inserted card 3. Two protrusions 121 respectively project from the side walls 12 of the base 10 for engaging with a metal shielding (not shown).

Each contact 11 has a mating portion 111 and a soldering portion 112 respectively extending through two outlets (not labeled) defined in the upper surface and either front or rear surfaces 105, 106 of the base 10. The mating portion 111 is to be in electrical contact with a corresponding contact (not shown) of the inserted card 3 and the soldering portion 112 is soldered to a printed circuit board (not shown).

Metal switch means 2 includes an elastic plate 21 and two switch plates 22, 23. The elastic plate 21 includes a first plate portion 211 retained in a first recess 132 defined in the first stop member 13A and a second plate portion 212 electrically connected to the metal switch plates 22, 23 which are partially received in the second stop member 13B and spaced apart from each other. For reinforcing engagement between the first plate portion 211 and the first recess 132, the first plate portion 211 is L-shaped and the first recess 132 is further defined with a perpendicular section 1321 for mating with the L-shaped first plate portion 211.

The elastic plate 21 has a first tab 213 extending horizontally from an intermediate portion 215 located between the first portion 211 and the second portion 212 and beyond a virtually aligned line defined between the first stop member 13A and the second stop member 13B. The intermediate portion 215 has a bent section 215B connected to the second portion 212 for facilitating contact of the second portion 212 of the elastic plate 21 with the switch plates 22, 23. A second tab 214 extends downward from one side of the first tab 213 for reinforcement purposes when the first tab 213 receives a force from the inserted card 3 (FIG. 3). The first and second tabs 213, 214 constitute a solid driving portion which remains undeformed even when receiving a force from impacted by the inserted card 3.

The second stop member 13B defines two second recesses 1332. The metal switch plates 22, 23 each have a contacting plane portion 221, 231, an engaging tab 222, 232 extending from the contacting plane portion 221, 231, and a slanted pin section 223, 233 oppositely extending from the direction of the tabs 222, 232. The switch plates 22, 23 are fixed to the second stop member 13B by engaging the tabs 222, 232 with the second recesses 1332 of the second stop member 13B.

The contacting plane portions 221, 231 of the metal switch plates 22, 23 each have a mating side 224, 234 proximate each other and are electrically connected together via the second plate portion 212 of the elastic plate 21 when the driving portion of the elastic plate 21 is not impacted by the inserted card 3.

First and second blocks 125, 126 respectively extend from traverse ends of the rear surface 106 of the base 10 for protecting the soldering portions 112 of the contacts 11 extending from the rear surface 106. Similarly, third and fourth blocks 127, 128 extend from traverse ends of the front surface 105 of the base 10 for protecting the soldering portions 112 of the contacts 11 extending from the front surface 105.

Particularly referring to FIG. 2, the switch means 2 is in a "closed " status since no card is inserted to separate the second portion 212 from the two switch plates 22, 23. Also referring to FIG. 3, a movable space 133 is defined between the second stop member 13B and the first block 125 for movement of the second portion 212 of the elastic plate 21 when the driving portion 213 of the elastic plate 21 receives a force from the inserted card 3. The elastic plate 21 is electrically disconnected from the two switch plates 22, 23 when the driving portion 213 thereof receives a force from the inserted card 3 whereby the switch 2 is in an "opened " status.

Two grooves 1333 are defined in a corner top surface of the base 10 for partially and interferentially receiving the pin sections 223, 233 of the switch plates 22, 23 thereby preventing the second portion 212 of the elastic plate 21 from electrically contacting with the switch plates 22, 23 when the second portion 212 of the elastic plate 21 is urged by the inserted card 3 to slide rearward along the corner top surface.

The elastic plate 21, the two switch plates 22, 23, and the first and second stop members 13A, 13B are positioned so that the card 3 is immediately stopped by the aligned stop members 13A, 13B right after the card 3 urges the elastic plate 21 away from the two switch plates 22, 23.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A card connector comprising an insulative housing having a base defining a plurality of passageways for receiving contacts therein, and a reception space defined between two opposite side walls extending upward from the base for receiving an externally inserted card, a first stop member and a second stop member separately projecting upward from the base and aligning with each other for stopping the externally inserted card, and an elastic plate having a first portion connected to the first stop member, a second portion electrically connected to two separated metal switch plates which are partially received in the second stop member, and a driving portion extending from an intermediate portion between the first portion and the second portion of the elastic plate and extending beyond an aligned line of the first stop member and the second stop member, each switch plate including a contacting surface for contacting the second portion of the elastic plate, a tab perpendicularly extending from the contacting surface for reception in a corresponding slit defined in the second stop member, and a pin section oppositely extending from the extended direction of the tab, whereby the elastic plate is electrically disconnected from the two switch plates when the driving portion thereof receives a force from the inserted card, and whereby the contacting area between the second portion of the elastic plate and the two metal switch plates is sufficiently large to reduce the contact resistance therebetween.

2. The card connector as claimed in claim 1, wherein the elastic plate, the two switch plates, the first stop member, and the second stop member are so positioned that right after the elastic plate is electrically disconnected from the two switch plates by an insertion force of the card, the card is immediately stopped by at least one of the stop members.

3. The card connector as claimed in claim 1, wherein a free space is defined between the first stop member and the second stop member for movement of the intermediate portion of the elastic plate upon receiving a force from the inserted card.

4. The card connector as claimed in claim 1 further comprising a block formed on one edge of the base and confronting the second stop member thus defining a movable space therebetween allowing movement of the second portion of the elastic plate therein.

5. The card connector as claimed in claim 1, wherein the first stop member defines a first recess for receiving the first portion of the elastic plate.

6. The card connector as claimed in claim 5, wherein the first portion of the elastic plate is an L-shaped plate received in the first recess of the first stop member.

7. The card connector as claimed in claim 1, wherein the intermediate portion of the elastic plate has a bent section connected to the second portion for facilitating contact of the second portion with the switch plates.

8. The card connector as claimed in claim 7, wherein two grooves are defined in the base for partially and interferentially receiving the pin section of the switch plates thereby guaranteeing separation between the second portion of the elastic plate and the contacting portions of the switch plates when the second portion of the elastic plate is urged to slide along a top surface containing the two grooves.

9. The card connector as claimed in claim 8, wherein the driving portion of the elastic plate comprises a first tab extending horizontally from the intermediate portion and a second tab extending perpendicularly from the first tab for reinforcing the first tab when the first tab receives the force from the inserted card.

10. A metal switch apparatus for use in a connector with an externally inserted card, comprising an elastic plate having a first portion fixed in the connector and a second portion connected to the first portion via an intermediate portion, and two contacting plates fixed in the connector and conductive to each other via simultaneous contact with the second portion of the elastic plate, a driving portion extending from the intermediate portion between the first portion and the second portion of the elastic plate, each of the switch plates including a contacting surface for contacting with the second portion of the elastic plate, a tab perpendicularly extending from the contacting surface for reception in a corresponding slit defined in the connector, whereby the two contacting plates are not conductive to each other when the card is inserted into the connector to a level in which the second portion of the elastic plate is urged by a force from the inserted card so as to depart from the two contacting plates.

11. A card connector comprising an insulative housing having a base defining a plurality of passageways for receiving contacts therein, and a reception space defined between two opposite side walls extending upward from the base for receiving an externally inserted card, a first stop member and a second stop member separately projecting upward from the base and aligning with each other for stopping the externally inserted card, and an elastic plate having a first portion connected to the first stop member, a second portion electrically connected to two separated metal switch plates which are partially received in the second stop member, and a driving portion extending from an intermediate portion between the first portion and the second portion of the elastic plate and extending beyond an aligned line of the first stop member and the second stop member, whereby the elastic plate is electrically disconnected from the two switch plates when the driving portion thereof receives a force from the inserted card, and whereby the contacting area between the second portion of the elastic plate and the two metal switch plates is sufficiently large to reduce the contact resistance therebetween, and wherein said card connector further comprises a block formed on one edge of the base and confronting the second stop member thus defining a movable space therebetween allowing movement of the second portion of the elastic plate therein.

* * * * *